United States Patent [19]

Ura

[11] Patent Number: 4,462,344

[45] Date of Patent: Jul. 31, 1984

[54] INTAKE AND EXHAUST MANIFOLD ARRANGEMENT OF INTERNAL COMBUSTION ENGINE

[75] Inventor: Syouzabu Ura, Yokohama, Japan

[73] Assignee: Nissan Motor Company, Limited, Yokohama, Japan

[21] Appl. No.: 341,264

[22] Filed: Jan. 21, 1982

[30] Foreign Application Priority Data

Jan. 30, 1981 [JP] Japan ..... 56-12577

[51] Int. Cl.[3] ..... F02M 35/00

[52] U.S. Cl. ..... 123/52 M; 123/59 R

[58] Field of Search ..... 123/52 M, 52 MV, 52 MC, 123/59 R

[56] References Cited

U.S. PATENT DOCUMENTS

| | | | |
|---|---|---|---|
| 1,944,206 | 1/1934 | Ball et al. | 123/52 M |
| 1,960,775 | 5/1934 | Fisher et al. | 123/52 M |
| 2,686,506 | 8/1954 | Carpentier et al. | 123/52 MV |

*Primary Examiner*—Craig R. Feinberg

*Attorney, Agent, or Firm*—Lane, Aitken & Kananen

[57] ABSTRACT

An intake and exhaust manifold arrangement of a multiple-cylinder internal combustion engine, comprising an intake manifold including branch portions leading to the intake ports and mounting flange members securely connecting the branch portions to the cylinder head, an exhaust manifold including branch portions leading from the exhaust ports and mounting flange members securely connecting the branch portions to the cylinder head, the branch portions of the exhaust manifold including at least one branch portion adjacent one of the branch portions of the intake manifold, and mounting bolts including at least one common mounting bolt securing the adjacent two branch portions of the intake and exhaust manifolds to the cylinder head, the one bolt and the two flange members having clearances provided therebetween in directions parallel with the direction in which the engine power cylinders are arranged in series, the adjacent two flange members being spaced apart from each other in a direction parallel with the aforesaid directions and having provided therebetween at least one minimum clearance smaller than each of the above mentioned predetermined clearances.

7 Claims, 5 Drawing Figures

INTAKE AND EXHAUST MANIFOLD ARRANGEMENT OF INTERNAL COMBUSTION ENGINE

FIELD OF THE INVENTION

The present invention relates in general to internal combustion engines and, particularly, to an intake and exhaust manifold arrangement of a multiple-cylinder internal combustion engine of the type having the intake and exhaust ports of the power cylinders located on one side of the cylinder head of the engine.

BACKGROUND OF THE INVENTION

A multiple-cylinder internal combustion engine of the counterflow type has the intake and exhaust ports of the power cylinders located on one side of the cylinder head of the engine. Serious space requirements are involved in an internal combustion engine of this type and, to overcome such requirements, a multiple-cylinder internal combustion engine of the counterflow type has intake and exhaust manifolds which partake common mounting bolts each connecting a branch portion of the intake manifold and a branch portion of the exhaust manifold to the cylinder head. Problems are, however, still encountered in an internal combustion engine of this nature and, thus, an object of the present invention is to provide a useful solution to these problems.

SUMMARY OF THE INVENTION

In accordance with the present invention, there is provided an intake and exhaust manifold arrangement of a multiple-cylinder internal combustion engine including a cylinder head and a plurality of power cylinders arranged in series and having intake and exhaust ports located on one side of the cylinder head, comprising an intake manifold including a plurality of branch portions leading to the intake ports and a plurality of mounting flange members securely connecting the branch portions to the cylinder head at the ends of the branch portions, an exhaust manifold including a plurality of branch portions leading from the exhaust ports and a plurality of mounting flange members securely connecting the branch portions to the cylinder head at the ends of the branch portions of the exhaust manifold, the flange members of the exhaust manifold including at least one flange member adjacent one of the flange members of the intake manifold, and a plurality of mounting bolts including at least one common mounting bolt for securing the adjacent two flange members of the intake and exhaust manifolds, the aforesaid one common mounting bolt and the aforesaid adjacent two mounting flange members having predetermined clearances respectively provided therebetween in a direction parallel with the direction in which the power cylinders of the engine are arranged in series, wherein the above mentioned adjacent two flange members are spaced apart from each other in a direction parallel with the aforesaid direction and have provided therebetween at least one predetermined minimum clearance smaller than each of the above mentioned predetermined clearances. The above mentioned predetermined minimum clearance is one of two predetermined clearances which are provided between the aforesaid two flange members at locations approximately diametrically opposite to each other across the one mounting bolt.

BRIEF DESCRIPTION OF THE DRAWINGS

Drawbacks of a prior-art intake and exhaust manifold arrangement of a multiple-cylinder internal combustion engine of the described nature and the features of an intake and exhaust manifold arrangement according to the present invention will be more clearly understood from the following description in which like reference numerals designate similar or corresponding members and structures and in which.

FURTHER DESCRIPTION OF THE PRIOR ART

Figure 1:
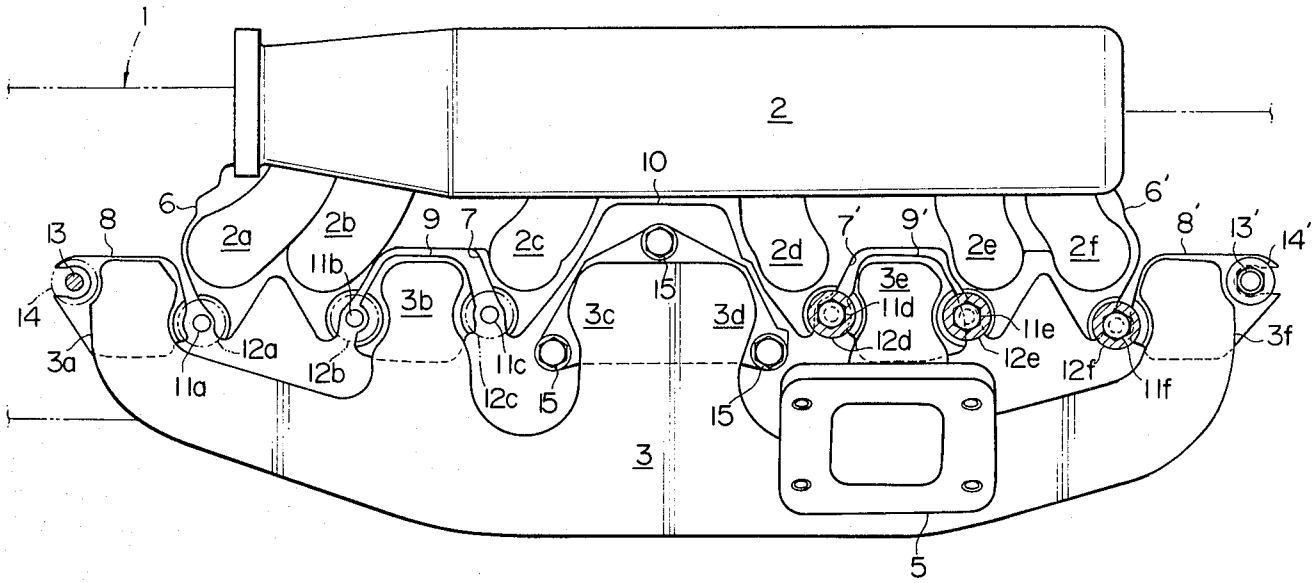
FIG. 1 PRIOR ART
FIG. 1 is a front view of a prior-art intake and exhaust manifold arrangement of a multiple-cylinder internal combustion engine of the counterflow type.
Figure 2:
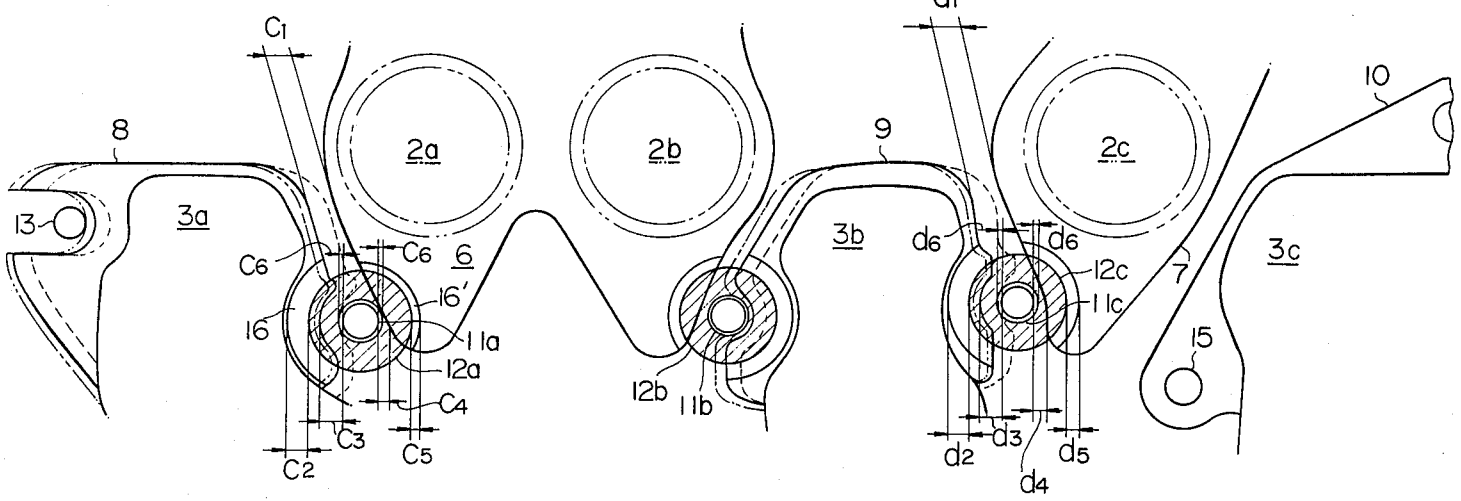
FIG. 2 PRIOR ART
FIG. 2 is a fragmentary front view showing, to an enlarged scale, one lateral half of the intake and exhaust manifold arrangement shown in FIG. 1.

Referring to FIGS. 1 and 2, a prior art intake and exhaust manifold arrangement of an internal combustion engine of the counterflow type is shown including a cylinder head 1 with an intake manifold 2 and an exhaust manifold 3 arranged thereon. The internal combustion engine is of the six-cylinder type and includes first to sixth power cylinders (not shown). The intake manifold 2 has first to sixth branch portions 2*a* to 2*f* respectively leading to the six power cylinders of the engine. Similarly, the exhaust manifold 3 includes first to sixth branch portions 3*a* to 3*f* also respectively leading from the six power cylinders of the engine. The middle two branch portions 3*c* and 3*d* of the exhaust manifold 3 jointly lead to the main body portion of the manifold 3. Designated by 5 is a coupling flange to which an exhaust pipe (not shown) is to be connected.

Of the branch portions 2*a* to 2*f* of the intake manifold 2, the first and second branch portions 2*a* and 2*b* are jointly connected to the cylinder head 1 by a mounting flange member 6 and, likewise, the fifth and sixth branch portions 2*e* and 2*f* are jointly connected to the cylinder head 1 by a mounting flange member 6'. The third and fourth branch portions 2*c* and 2*d* are connected to the cylinder head 1 by mounting flange members 7 and 7', respectively. In the exhaust manifold 3, the first and second branch portions 3*a* and 3*b* are connected to the cylinder head 1 by mounting flange members 8 and 9, respectively, and, likewise, the sixth and fifth branch portions 3*f* and 3*e* are connected to the cylinder head 1 by mounting flange members 8' and 9', respectively. The middle two branch portions 3*c* and 3*d* of the exhaust manifold 3 are jointly connected to the cylinder head 1 by a mounting flange member 10.

The mounting flange members 6, 6', 7, 7', 8, 8', 9, 9' and 10 are fastened to the cylinder head 1 by first to sixth common mounting bolts 11*a* to 11*f* and first to sixth yokes 12*a* to 12*f*. More specifically, the mounting flange members 6 and 8 are fastened to the cylinder head 1 by the first common mounting bolt 11*a* and the first yoke 12*a*. The mounting flange member 6 is further secured to the cylinder head 1 by the second common mounting bolt 11*b* and the second yoke 12*b* which further serve to have the flange member 9 secured to the cylinder head 1. The mounting flange member 9 is further secured to the cylinder head 1 by the third common mounting bolt 11*c* and the third yoke 12*c* which further serve to have the flange member 7 for the third branch portion 2*c* of the intake manifold 2 secured to the cylinder head 1. The fourth, fifth and sixth common mounting bolts and yokes 11*d* to 11*f* and 12*d* to 12*f* are arranged similarly to the third, second and first common mounting bolts and yokes 11*c* to 11*a* and 12*c* to 12*a*, respectively. Each combination of each common mounting bolt and the associated yoke is thus used to have one of the mounting flange members for the intake manifold 2 and the adjacent one of the mounting flange members for the exhaust manifold 3 secured to the cylinder head 1. The flange members 8 and 8' are secured to the cylinder head 1 by not only the first and sixth common mounting bolts 11*a* and 11*f* and the first and sixth yokes 12*a* and 12*f*, respectively, but bolts 13 and 13' and washers 14 and 14' which are proper to the mounting flange members 8 and 8', respectively. Furthermore, the central mounting flange member 10 is secured to the cylinder head 1 by bolts 15 and washers (not shown) which are proper to the mounting flange member 10.

In the conventional manifold arrangement above described, the mounting flange members 8, 6, 9, 7, 10, 7', 9', 6' and 8' are designed and arranged in such a manner as to have adequate clearances between every adjacent two thereof. Such a design consideration is required to preclude production of undue stresses in the structural wall portions of the intake and exhaust manifolds 2 and 3 due to the thermal expansion of the wall portions. The clearances provided between the individual mounting flange members are thus selected in consideration of the specific locations of the common mounting bolts 11*a* to 11*f* and yokes 12*a* to 12*f*. In respect of, for instance, the mounting flange member 6 for the first and second branch portions 2*a* and 2*b* of the intake manifold 2 and the mounting flange member 8 for the first branch portion 3*a* of the exhaust manifold 3, clearances $c_1$, $c_2$, $c_3$, $c_4$, $c_5$ and $c_6$ are respectively provided therebetween in a direction parallel with the direction in which the power cylinders are arranged in series, as indicated in FIG. 2. In this instance, the clearance $c_1$ is provided as the initial spacing between the mounting flange member 6 and the mounting flange member 8. The clearance $c_2$ is provided as the initial spacing between the outer peripheral surface of the first yoke 12*a* and the outside-diameter end face of the arcuate sunk surface portion which the mounting flange member 8 has to have the yoke 12*a* partially seated thereon, the sunk surface portion being indicated by reference numeral 16 in FIG. 2. The clearance $c_3$ is provided as the initial spacing between the mounting flange member 8 and the stem portion of the first common mounting bolt 11*a*, and the clearance $c_4$ is provided as the initial spacing between the mounting flange member 6 and the stem portion of the first common mounting bolt 11*a*. Furthermore, the clearance $c_5$ is provided as the initial spacing between the outer peripheral surface of the yoke 12*a* and the outside-diameter end face of the arcuate sunk surface portion (indicated by 16') which the mounting flange member 6 has to have the yoke 12*a* seated thereon. The clearance $c_6$ is provided as the initial spacing between the inner peripheral surface of the yoke 12*a* and the stem portion of the bolt 11*a*. Clearances similar to the above mentioned clearances $c_1$, $c_2$, $c_3$, $c_4$, $c_5$ and $c_6$ are provided between the mounting flange member 7 for the third branch portion 2*c* of the intake manifold 2 and the mounting flange member 9 for the second branch portion 3*b* of the exhaust manifold 3 as indicated by $d_1$, $d_2$, $d_3$, $d_4$, $d_5$ and $d_6$ in FIG. 2.

When the internal combustion engine is operating under high-speed, high-load conditions, the structural wall portions of the exhaust manifold 3 is subjected to increased thermal loads, which tend to cause each of the mounting flange members 8, 8', 9, and 9' for the exhaust manifold 3 to be dislodged on the cylinder head 1 in directions parallel with the directions in which the power cylinders of the internal combustion engine are arranged, as indicated by dots-and-dash lines in FIG. 2. If unusually high thermal loads are applied to the structural wall portions of the exhaust manifold 3, the outermost two mounting flange members 8 and 8' are dislodged from their respective initial positions (indicated by full lines in FIG. 2) on the cylinder head 1 to such extents as to abut to the associated bolts 13 and 13', respectively, while the intermediate two mounting flange members 9 and 9' are dislodged to such extents as to abut to the associated second and fifth common mounting bolts 11*b* and 11*e*, respectively. When these occur, the structural wall portions of the exhaust manifold 3 are subjected not only to the thermal loads but also to relatively high degrees of compressive stresses.

When the internal combustion engine is thereafter shut down and is allowed to be cooled with the ambient air, the structural wall portions of the exhaust manifold 3 are allowed to shrink so that the mounting flange members 8, 8', 9 and 9' which have been thus dislodged are permitted to and restore their respective initial positions on the cylinder head 1. The repetition of the cooling and heating cycles which the internal combustion engine thus encounters causes creep in the structural wall portions of the exhaust manifold 3 due to the abutment of the mounting flange members to the mounting bolts for the branch portions of the exhaust manifold 3. When the exhaust manifold 3 is subjected to higher thermal loads, the creep is the more serious. The structural wall portions of the exhaust manifold 3 even tend to shrink from the initial states thereof due to the creep thus caused therein so that the mounting flange members such as the mounting flange members 8, 8', 9 and 9' for the 3*a*, 3*b*, 3*e* and 3*f*, respectively, of the exhaust manifold 3 are caused to be displaced from their respective initial positions on the cylinder head 1 as indicated by broken lines in FIG. 2 under low temperature conditions of the engine, viz., when the engine is held at rest. When this occurs on, for example, the mounting flange member 8 for the first branch portion 3*a* of the exhaust manifold 3, the mounting flange member 8 may be caused to abut at its rightside end against the leftside end of the stem portion of the first mounting bolt 11*a* because of the fact that the clearance $c_3$ is smaller than each of the clearances $c_1$ and $c_2$. For similar reasons, the mounting flange member 9 for the second branch portion 3*b* of the exhaust manifold 3 may be caused to abut at its rightside ends against the stem portions of the third mounting bolts 11*c*. Likewise, the mounting flange member 9' for the fifth branch portion 3*e* of the exhaust manifold 3 may be caused to abut at its leftside end against the stem portions of the fourth mounting bolt 11*d*, and the mounting flange member 8' for the sixth branch portion 3*f* may be caused to abut at its leftside end against the rightside end of the stem portion of the sixth mounting bolt 11*f*.

The tendency of the mounting flange members 8, 8', 9 and 9' to be displaced from their initial positions on the cylinder head 1 due to the creation of creep in the exhaust manifold 3 is exhibited the more pronouncedly as the internal combustion engine experiences the repeated heating and cooling cycles at higher frequencies under high-speed, high-load conditions thereof. When the engine is operated under some unusual conditions requiring extremely frequent repetition of heating and cooling cycles, the mounting flange members 8, 8', 9 and 9' are therefore caused to forcefully depress the associated mounting bolts 11*a* to 11*f* and produce unusual shearing stresses in the bolts. This results in early fatigue and even breaks of the mounting bolts 11*a* to 11*f*. The present invention contemplates elimination of these problems which have thus far been encountered in conventional intake and exhaust manifold arrangements of internal combustion engines.

DESCRIPTION OF THE PREFERRED EMBODIMENTS

Figure 3:
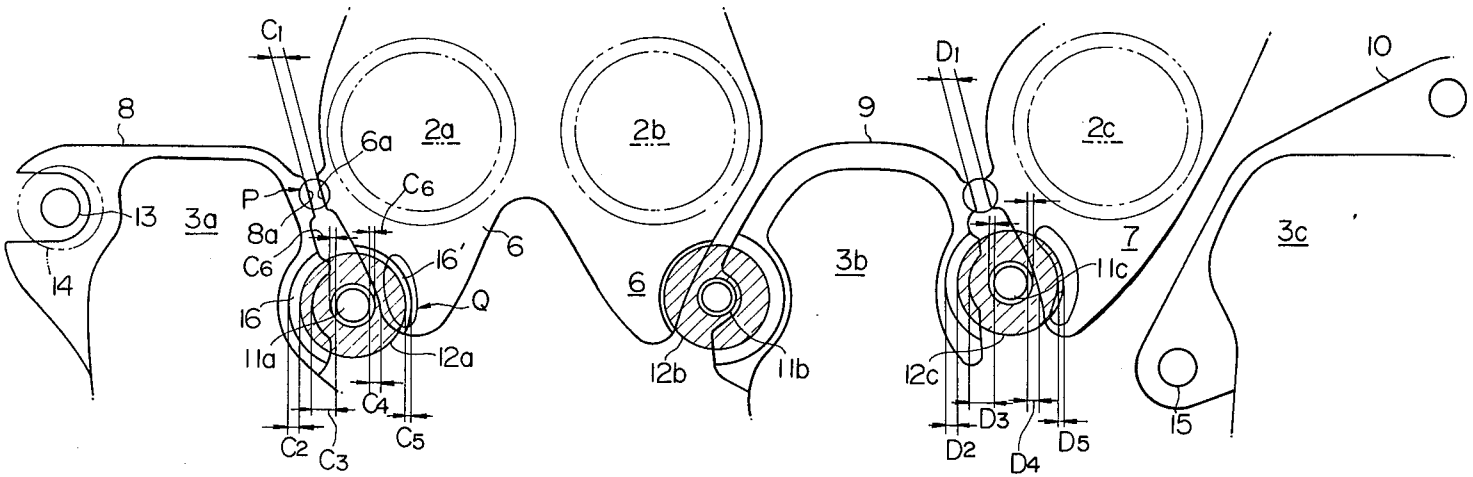
FIG. 3 is a view similar to FIG. 2 but shows a lateral half of a first preferred embodiment of an intake and exhaust manifold arrangement according to the present invention.

Referring to FIG. 3 , a multiple-cylinder internal combustion engine having incorporated therein the improvements according to the present invention is assumed, by way of example, as being generally similar to the internal combustion engine including the prior-art manifold arrangement shown in FIGS. 1 and 2 and is thus shown including a cylinder head 1 and power cylinders respectively having intake and exhaust ports located on one and the same side of the cylinder head 1. The intake and exhaust manifold arrangement includes an intake manifold 2 and an exhaust manifold 3 which are arranged on one side of the cylinder head 1 of the engine. In FIG. 3, furthermore, only a left half of the intake and exhaust manifold arrangement is shown since the remaining right half of the intake and exhaust manifold arrangement is a symmetric version of the left half. The internal combustion engine including such an intake and exhaust manifold arrangement is assumed to be of the six-cylinder type and comprises first to sixth power cylinders.

The intake manifold 2 has six branch portions which consist of first, second and third branch portions 2*a*, 2*b* and 2*c* as shown and fourth, fifth and sixth branch portions, not shown. The first, second and third branch portions 2*a*, 2*b* and 2*c* are shown arranged from left to right in this sequence and are assumed to respectively lead to the first, second and third power cylinders of the internal combustion engine. Though not shown in FIG. 3, the fourth, fifth and sixth branch portions are also arranged from left to right in this sequence and are assumed to respectively lead to the fourth, fifth and sixth power cylinders of the internal combustion engine. Similarly, the exhaust manifold 3 has six branch portions which consist of first, second and third branch portions 3*a*, 3*b* and 3*c* as shown and fourth, fifth and sixth branch portions, not shown. The first, second and third branch portions 3*a*, 3*b* and 3*c* are shown arranged from left to right in this sequence and are assumed to respectively lead from the first, second and third power cylinders of the internal combustion engine. Though not shown, the fourth, fifth and sixth branch portions are also arranged from left to right in this sequence and are assumed to respectively lead from the fourth, fifth and sixth power cylinders of the engine. The middle two, viz., the third branch portion 3*c* and the fourth branch portion of the exhaust manifold 3 are siamesed and thus jointly lead to the main body portion of the manifold 3. Designated by 5, as shown in FIG. 1, is a coupling flange to which an exhaust pipe (not shown) is to be connected.

Of the six branch portions of the intake manifold 2, the leftmost two branch portions, viz., the first and second branch portions 2*a* and 2*b* are paired and are jointly connected at their ends to the cylinder head 1 by a mounting flange member 6 and, likewise, the rightmost two branch portions, viz., the fifth and sixth branch portions are paired and are jointly connected at their ends to the cylinder head 1 by a mounting flange member (not shown) similar to the above mentioned mounting flange member 6. The middle two branch portions., viz., the third branch portion 2*c* and the fourth branch portion of the intake manifold 2 are connected at their ends to the cylinder head 1 respectively by a mounting flange member 7 and a mounting flange member (not shown) similar to the mounting flange member 7. In the exhaust manifold 3, on the other hand, the leftmost two branch portions, viz., the first and second branch portions 3*a* and 3*b* are connected at their ends to the cylinder head 1 by mounting flange members 8 and 9, respectively, and, likewise, the rightmost two branch portions, viz., the sixth and fifth branch portions are connected at their ends to the cylinder head 1 by mounting flange members respectively similar to the above mentioned mounting flange members 8 and 9. The siamesed middle two branch portions, viz., the third branch portion 3*c* and the fourth branch portion of the exhaust manifold 3 are jointly connected at their ends to the cylinder head 1 by a mounting flange member 10 as shown. Each of the mounting flange members above mentioned has an arcuate sunk surface portion to have the associated yoke or each of the associated yokes partially seated thereon, the sunk surface portion being arcuately curved inwardly of the mounting flange member about the center axis of the yoke received thereon. The individual mounting flange members above mentioned are fastened to the cylinder head 1 by six common mounting bolts and six annular yokes respectively associated with the bolts. The six common mounting bolts consist of first, second and third common mounting bolts 11*a*, 11*b* and 11*c* as shown and fourth, fifth and sixth common mounting bolts, not shown. On the other hand, the six yokes consist of first, second and third yokes 12*a*, 12*b* and 12*c* as shown and fourth, fifth and sixth yokes, not shown.

Each combination of each common mounting bolt and the associated yoke is used to have one of the mounting flange members for the intake manifold 2 and the adjacent one of the mounting flange members for the exhaust manifold 3 secured to the cylinder head 1. The combination of, for instance, the first common mounting bolt 11*a* and the first yoke 12*a* is used for securing to the cylinder head 1 both of the mounting flange member 6 for the first and second branch portions 2*a* and 2*b* of the intake manifold 2 and the mounting flange member 8 for the first branch portion 3*a* of the exhaust manifold 3 to. The combination of the second common mounting bolt 11*b* and the second yoke 12*b* is used for securing to the cylinder head 1 both of the mounting flange member 6 for the first and second branch portions 2*a* and 2*b* of the intake manifold 2 and the mounting flange member 9 for the second branch portion 3*b* of the exhaust manifold 3. The combination of the third common mounting bolt 11*c* and the third yoke 12*c* is used for securing to the cylinder head 1 both of the mounting flange member 7 for the third branch portion 2*c* of the intake manifold 2 and the mounting flange member 9 for the second branch portion 3*b* of the exhaust manifold 3. The combination of the fourth common mounting bolt and the fourth yoke is used for securing to the cylinder head 1 both of the mounting flange member for the fourth branch portion of the intake manifold 2 and the mounting flange member for the fifth branch portion of the exhaust manifold 3. The combination of the fifth common mounting bolt and the fifth yoke is used for securing to the cylinder head 1 both of the mounting flange member for the fifth and sixth branch portions of the intake manifold 2 and the mounting flange member for the fifth branch portion of the exhaust manifold 3. The combination of the sixth common mounting bolt and the sixth yoke is used for securing to the cylinder head 1 both of the mounting flange member for the fifth and sixth branch portions and of the intake manifold 2 and the mounting flange member for the sixth branch portion of the exhaust manifold 3. The leftmost mounting flange member, viz., the mounting flange member 8 for the first branch portion 3*a* of the exhaust manifold 3 is secured to the cylinder head 1 by not only the first common mounting bolt 11*a* and the first yoke 12*a* but a bolt 13 and a washer 14 which are proper to the mounting flange member 8. Likewise, the rightmost mounting flange member, viz., the mounting flange member for the sixth branch portion of the exhaust manifold 3 is secured to the cylinder head 1 by not only the sixth common mounting bolt and the sixth yoke but a bolt and a washer which are proper to the mounting flange member, though not shown in FIG. 3. Furthermore, the central mounting flange member 10 for the third and fourth branch portions of the exhaust manifold 3 is secured to the cylinder head 1 by the aid of bolts 15 and washers (not shown) which are proper to the mounting flange member 10.

In the intake and exhaust manifold arrangement embodying the present invention as above described, the mounting flange members included therein are designed and arranged in such a manner as to have adequate clearances between every adjacent two thereof, as in the prior-art intake and exhaust manifold arrangement shown in FIGS. 1 and 2. In respect of, for instance, the combination of the mounting flange member 6 for the first and second branch portions 2*a* and 2*b* of the intake manifold 2 and the mounting flange member 8 for the first branch portion 3*a* of the exhaust manifold 3, clearances $C_1$, $C_2$, $C_3$, $C_4$, $C_5$ and $C_6$ are provided between the mounting flange members 6 and 8 and the associated common mounting bolt 11*a* and yoke 12*a* in directions parallel with the direction in which the power cylinders are arranged in series. In this instance, the clearance $C_1$ is provided as the initial spacing between the mounting flange member 6 and the mounting flange member 8. The clearance $C_2$ is provided as the initial spacing between the outer peripheral surface of the first yoke 12*a* and the outside-diameter end face of the arcuate sunk surface portion 16 which the mounting flange member 8 has to have the yoke 12*a* partially seated thereon. On the other hand, the clearance $C_3$ is provided as the initial spacing between the mounting flange member 8 and the stem portion of the first common mounting bolt 11*a*, and the clearance $C_4$ is provided as the initial spacing between the mounting flange member 6 and the stem portion of the first common mounting bolt 11*a*. Furthermore, the clearance $C_5$ is provided as the initial spacing between the outer peripheral surface of the yoke 12*a* and the outside-diameter end face of the arcuate sunk surface portion 16' which the mounting flange member 6 has to have the yoke 12*a* partially seated thereon, while the clearance $C_6$ is provided as the initial spacing between the inner peripheral surface of the yoke 12*a* and the stem portion of the bolt 11*a*. Clearances respectively similar to the above mentioned clearances $C_1$, $C_2$, $C_3$, $C_4$, $C_5$ and $C_6$ are provided between the mounting flange member 7 for the third branch portion 2*c* of the intake manifold 2 and the mounting flange member 9 for the second branch portion 3*b* of the exhaust manifold 3 as indicated by $D_1$, $D_2$, $D_3$, $D_4$, $D_5$ and $D_6$ in FIG. 3.

In the intake and exhaust manifold arrangement embodying the present invention every adjacent two of the mounting flange members included therein are shaped and/or sized so that the two mounting flange members are brought into abutting engagement with each other either directly or through the yoke provided therebetween when the mounting flange members connected thereto are displaced from their respective initial positions on the cylinder head 1 as a result of the contraction of the wall portions of the manifold 3 due to the creep caused therein during high-speed, high-load operating conditions of the engine. For example, the mounting flange member 6 for the first and second branch portions 2*a* and 2*b* of the intake manifold 2 and the mounting flange member 8 for the first branch portion 3*a* of the exhaust manifold 3 are shaped and sized in such a manner as to be brought into abutting engagement with each other directly in the region indicated by P and through the first yoke 12*a* in the region indicated by Q when the mounting flange member 8 on the exhaust manifold 3 is caused to approach the mounting flange member 6 of the intake manifold 2 as a result of the contraction of the structural wall portions of the exhaust manifold 3. More specifically, the mounting flange members 6 and 8 are shaped and sized so that the clearance $C_1$ between the mounting flange members 6 and 8 is smaller in the region P than the clearance $C_1$ in the prior-art intake and exhaust manifold arrangement shown in FIGS. 1 and 2 and that the following relationship hold among the clearances $C_1$, $C_2$, $C_3$, $C_4$, $C_5$ and $C_6$:

(a) The clearance $C_1$ between the mounting flange members 6 and 8 is smaller than the clearance $C_3$ between the mounting flange member 8 and the stem portion of the first common mounting bolt 11*a*, hence $C_1 < C_3$.

(b) The clearance $C_1$ between the flange members 6 and 8 is substantially equal to the sum of the clearance $C_2$ between the outer peripheral surface of the first yoke 12*a* and the outside-diameter end face of the arcuate sunk surface portion 16 of the mounting flange member 8 and the clearance $C_6$ between the stem portion of the first common mounting bolt 11*a* and the inner peripheral surface of the yoke 12*a*, hence $C_1 = C_2 + C_6$.

(c) The clearance $C_5$ between the outer peripheral surface of the first yoke 12*a* and the outside-diameter end face of the arcuate sunk surface portion 16' of the mounting flange member 6 is substantially equal to the clearance $C_6$ between the stem portion of the first common mounting bolt 11*a* and the inner peripheral surface of the yoke 12*a*, hence $C_5=C_6$.

To achieve the reduced clearance $C_1$ between the mounting flange members 6 and 8 in the region P in the embodiment shown in FIG. 3, the flange members 6 and 8 are formed with protrusions 6*a* and 8*a*, respectively, which have respective end faces spaced apart from each other in a direction parallel with the direction in which the power cylinders of the engine are arranged in series. Thus, the protrusions 6*a* and 8*a* of the mounting flange members 6 and 8, respectively, form in the region P a gap corresponding to the clearance $C_1$.

When the internal combustion engine provided with the intake and exhaust manifold arrangement having the mounting flange members 6 and 8 shaped and sized as above described is frequently shifted between rest conditions and high-speed, high-load operating conditions, creep is caused in the structural wall portions of the exhaust manifold 3 so that the wall portions of the manifold 3 are caused to shrink when the engine is shut down as in the prior-art intake and exhaust manifold arrangement described with reference to FIGS. 1 and 2. This causes the mounting flange member 8 of the exhaust manifold 3 to be displaced on the cylinder head 1 toward the mounting flange member 6 of the intake manifold 2 and accordingly approaches the stem portion of the first common mounting bolt 11*a*. The displacement of the mounting flange member 8 on the cylinder head 1 results in decreases in the clearance $C_1$ between the flange members 6 and 8 and in the clearance $C_3$ between the mounting flange member 8 and the stem portion of the common mounting bolt 11*a*. Because, in this instance, of the fact that the clearance $C_1$ is smaller than the clearance $C_3$ as above noted in paragraph (a), the protrusion 8*a* of the mounting flange member 8 is brought into abutting engagement with the protrusion 6*a* of the mounting flange member 6 before the flange member 8 is permitted to reach the stem portion of the common mounting bolt 11*a*. As the mounting flange member 8 on the exhaust manifold 3 is displaced toward the mounting flange member 6 of the intake manifold 2, furthermore, the yoke 12*a* is contacted by the outside-diameter end face of the sunk surface portion 16 of the flange member 8 and is thereby pressed toward the mounting flange member 6 of the intake manifold 2. As a consequence, the yoke 12*a* is forced to move toward the outside-diameter end face of the sunk surface portion 16' of the flange member 6 and ultimately has its outer peripheral surface brought into abutting engagement with the outside-diameter end face of the surface portion 16'. Since, in this instance, the sum of the clearances $C_2$ and $C_6$ is substantially equal to the clearance $C_1$ as stated in paragraph (b) above and since the clearance $C_6$ is substantially equal to the clearance $C_5$ as stated in paragraph (c) above, the outer peripheral surface of the yoke 12*a* is brought into abutting engagement with the outside-diameter end face of the surface portion 16' simultaneously when the inner peripheral surface of the yoke 12*a* comes into contact with the stem portion of the common mounting bolt 11*a* in the above mentioned region Q. The mounting flange member 8 on the exhaust manifold 3 is in these manners brought into pressing engagement with the mounting flange member 6 of the intake manifold 2 directly in the region P and through the intermediary of the yoke 12*a* and is thereby precluded from being brought into pressing engagement with the common mounting bolt 11*a* when the structural wall portions of the exhaust manifold 3 are caused to shrink.

While the features of the embodiment shown in FIG. 3 have been described only in connection with the combination of the mounting flange members 6 and 8 of the exhaust manifold 3 and exhaust manifold 3, respectively, similar features are provided for the combination of the mounting flange member 7 for the third branch portion 2*c* of the intake manifold 2 and the mounting flange member 9 for the second branch portion 3*b* of the exhaust manifold 3 as shown, as well as the combination of the mounting flange member for the fourth branch portion of the intake manifold 2 and the mounting flange member for the fifth branch portion of the exhaust manifold 3, and the combination of the mounting flange member for the fifth and sixth branch portion of the intake manifold 2 and the sixth branch portion of the exhaust manifold 3, though not shown in FIG. 3. In connection with the mounting flange members 7 and 9 shown in FIG. 3, suffice it to say that the clearance is reduced to $D_1$ and that the relationships similar to those previously specified in paragraphs (a), (b) and (c) hold.

Figure 4:
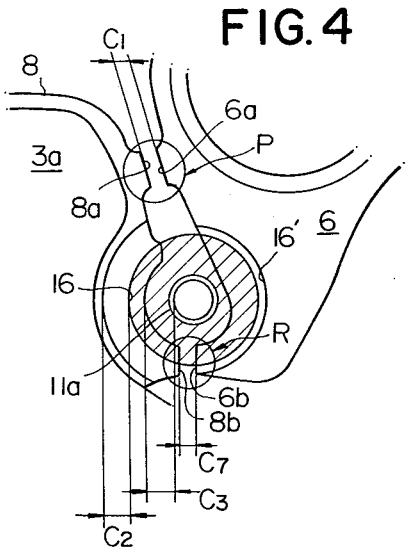
FIG. 4 is a fragmentary front view of portions of a second preferred embodiment of an intake and exhaust manifold arrangement according to the present invention.

Description will be hereinafter made with reference to FIG. 4 which shows a second preferred embodiment of the intake and exhaust manifold arrangement according to the present invention. In FIG. 4, the embodiment of the present invention is shown only in connection with the combination of the mounting flange member 6 for the branch portions 2*a* and 2*b* of the intake manifold 2 and the mounting flange member 8 for the first branch portion 3*a* of the exhaust manifold 3.

In the intake and exhaust manifold arrangement shown in FIG. 4, the mounting flange members 6 and 8 are shaped and sized similarly in the region P to their respective counterparts in the embodiment of FIG. 3 and are formed with the protrusions 6*a* and 8*a*, respectively. The clearance between the mounting flange members 6 and 8 is, thus, formed between the protrusions 6*a* and 8*a* thereof and is given by clearance $C_1$ as in the embodiment of FIG. 3. In a region R which is approximately diametrically opposite to the region P across the center axis of the common mounting bolt 11*a*, the mounting flange members 6 and 8 of the embodiment shown in FIG. 4 are further formed with lug portions 6*b* and 8*b*, respectively, which protrude toward each other and which have respective end faces spaced apart in parallel from each other in a direction parallel with the direction in which the power cylinders are arranged in series. The end faces of the lug portions 6*b* and 8*b* are spaced apart from each other so as to provide therebetween a predetermined clearance $C_7$ which is substantially equal to the clearance $C_1$ between the respective protrusions 6*a* and 6*b* of the mounting flange members 6 and 8. It will be apparent that the clearance $C_7$ is substantially smaller than the clearance $C_3$ between the mounting flange member 8 and the stem portion of the common mounting bolt 11*a*.

When, now, the mounting flange member 8 on the exhaust manifold 3 is displaced on the cylinder head 1 toward the mounting flange member 6 of the intake manifold 3 as a result of the contraction of the structural wall portions of the cylinder head 1, the protrusion 8*a* and lug portion 8*b* of the mounting flange member 8 are brought into abutting engagement with the protrusion 6*a* and lug portion 6*b*, respectively, of the mounting flange member 6 on the cylinder head 1. Because, in this instance, of the fact that each of the clearance $C_1$ between the protrusions 6*a* and 8*a* and the clearance $C_7$ between the lug portions of 6b and 8b is smaller than the clearance $C_3$ as above noted, the protrusion 8a and lug portion 8b of the mounting flange member 8 are brought into abutting engagement with the protrusion 6a and lug portion 6b, respectively, of the mounting flange member 6 before the flange member 8 is permitted to reach the stem portion of the common mounting bolt 11a. The mounting flange member 8 on the exhaust manifold 3 is in these manners brought into pressing engagement with the mounting flange member 6 of the intake manifold 2 directly in the regions P and R and is thereby precluded from being brought into pressing engagement with the common mounting bolt 11a when the structural wall portions of the exhaust manifold 3 are caused to shrink.

Figure 5:
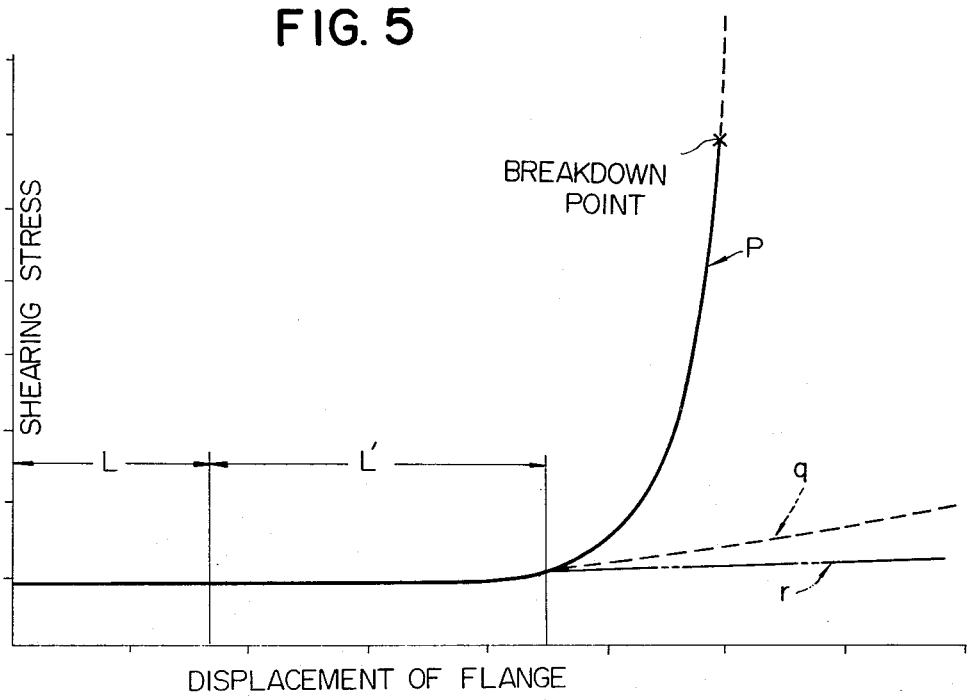
FIG. 5 is a graph showing curves which indicate the variation of the shearing stress produced in a common mounting bolt in each of the prior-art intake and exhaust manifold arrangement shown in FIGS. 1 and 2 and the first and second preferred embodiments of the intake and exhaust manifold arrangement according to the present invention.

The advantages of the manifold arrangement proposed by the present will be visually appreciated from curves p, q and r shown in FIG. 5. In FIG. 5, the curve p indicates the variation of the shearing stress produced in a common mounting bolt as a result of the displacement of the associated mounting flange member of the exhaust manifold 3 in the prior part intake and exhaust manifold arrangement shown in FIGS. 1 and 2. The curve q indicates the variation of the shearing stress produced in a common mounting bolt as a result of the displacement of the associated mounting flange member of the exhaust manifold 3 in the embodiment of FIG. 3, while the curve r indicates the variation of the shearing stress produced in a common mounting bolt as a result of the displacement of the associated mounting flange member of the exhaust manifold 3 in the embodiment of FIG. 4. In FIG. 5, the displacement range indicated by L is the range in which the deformation of the structural wall portions of the exhaust manifold 3 is limited by the resistance of the yoke while the displacement range indicated by L' is the range in which the flange member is permitted to move without being subjected to resistance by the mounting bolt.

What is claimed is:

1. In a multiple-cylinder internal combustion engine including a cylinder head, a plurality of power cylinders arranged in series and having intake and exhaust ports located on one side of the cylinder head, an intake manifold including a plurality of branch portions leading to the intake ports and a plurality of mounting flange members securely connecting the branch portions to the cylinder head at the ends of the branch portions, an exhaust manifold including a plurality of branch portions leading from the exhaust ports and a plurality of mounting flange members securely connecting the branch portions to the cylinder head at the ends of the branch portions of the exhaust manifold, the flange members of the exhaust manifold including at least one flange member adjacent one of the flange members of the intake manifold, and a plurality of mounting bolts including at least one common mounting bolt for securing the adjacent two flange members of the intake and exhaust manifolds, said one common mounting bolt and said adjacent two flange members having predetermined clearances respectively provided between the common mounting bolt and one of the adjacent two flange members and between the common mounting bolt and the other of the adjacent two flange members in a direction parallel with the direction in which the power cylinders of the engine are arranged in series, wherein the improvement comprises an intake and exhaust manifold arrangement in which said adjacent two flange members are spaced apart from each other in a direction parallel with said direction and have provided therebetween one region with at least one predetermined minimum clearance smaller than at least one of said respectively provided predetermined clearances.

2. The improvement as set forth in claim 1, in which said at least one predetermined minimum clearance is two predetermined minimum clearances which are provided between said adjacent two flange members at locations approximately diametrically opposite to each other across said one common mounting bolt.

3. The improvement as set forth in claim 2, in which said adjacent two flange members have respective protrusions having end faces spaced apart from each other and forming said predetermined minimum clearance therebetween, and respective lug portions having end faces spaced apart from each other and forming therebetween a clearance substantially equal to the clearance between said protrusions.

4. The improvement as set forth in claim 3, in which the end faces of said protrusions are substantially parallel with each other and in which the end faces of said lug portions are substantially parallel with each other.

5. The improvement as set forth in claim 1 or 2, wherein said internal combustion engine further includes at least one unitary annular yoke member which said one common mounting bolt tightens onto said adjacent two flange members of the intake and exhaust manifolds, said yoke member coaxially surrounding the stem portion of said one common mounting bolt, said adjacent two flange members being respectively formed with arcuate sunk surface portions which are arcuately curved inwardly about the stem portion of said one common mounting bolt and each of which is partly defined by an outside-diameter end face arcuately surrounding the stem portion of said one common mounting bolt, said yoke member being received on said arcuate sunk surface portions and in part coaxially surrounded by the respective outside-diameter end faces of the sunk surface portions, the improvement further comprising the arrangement in which said adjacent two flange members, the stem portion of said one common mounting bolt and said yoke member are spaced apart from each other in said directions and have provided therebetween predetermined minimum clearances including a first clearance provided between said adjacent two flange members, a second clearance provided between the outer peripheral surface of said yoke member and the outside-diameter end face of the arcuate sunk surface portion of one of said adjacent two flange members which forms part of the exhaust manifold, a third clearance provided between the stem portion of said one common mounting bolt and one of said adjacent two flange members which forms part of the exhaust manifold, a fourth clearance provided between the stem portion of said one common mounting bolt and the other of said adjacent two flange members which forms part of the intake manifold, a fifth clearance provided between the outer peripheral surface of said yoke member and the outside-diameter end face of the arcuate sunk surface portion of the other of said adjacent two flange members which forms part of the intake manifold, and a sixth clearance provided between the inner peripheral surface of said yoke member and the stem portion of said one common mounting bolt, wherein said first clearance is smaller than said third clearance and is substantially equal to the sum of said second clearance and said sixth clearance and wherein said fifth clearance is substantially equal to said sixth clearance.

6. The improvement as set forth in claim 1 or 2, in which said adjacent two flange members have respective protrusions having end faces spaced apart from each other and forming said predetermined minimum clearance therebetween.

7. The improvement as set forth in claim 6, in which the end faces of said protrusions are substantially parallel with each other.

* * * * *